US010253982B2

(12) United States Patent
Suzuki et al.

(10) Patent No.: US 10,253,982 B2
(45) Date of Patent: Apr. 9, 2019

(54) GLOW PLUG WITH PRESSURE SENSOR

(71) Applicant: NGK Spark Plug Co., LTD., Nagoya (JP)

(72) Inventors: Hiroyuki Suzuki, Kasugai (JP); Hiroki Tsuchiya, Komaki (JP); Akimitsu Sassa, Toukai (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 118 days.

(21) Appl. No.: 14/579,459

(22) Filed: Dec. 22, 2014

(65) Prior Publication Data

US 2016/0177909 A1 Jun. 23, 2016

(51) Int. Cl.
*F23Q 7/00* (2006.01)

(52) U.S. Cl.
CPC ..... *F23Q 7/001* (2013.01); *F23Q 2007/002* (2013.01); *F23Q 2007/005* (2013.01)

(58) Field of Classification Search
CPC ..... F23Q 7/001; G01L 23/22; G01L 23/24; G01L 23/00; G01L 23/08; F01P 7/165; F02M 26/24
USPC ..... 219/270, 260, 267; 123/145 A; 73/114.18; 7/35.12
See application file for complete search history.

(56) References Cited

U.S. PATENT DOCUMENTS 7,635,826 B2 * 12/2009 Yamada ..... F23Q 7/001 219/260
7,765,974 B2 * 8/2010 Boucard ..... F01P 7/165 123/143 R
7,825,352 B2 * 11/2010 Last ..... F23Q 7/001 123/145 A
8,003,917 B2 * 8/2011 Kern ..... F23Q 7/001 219/260
8,772,677 B2 * 7/2014 Suzuki ..... F23Q 7/001 123/145 A
8,893,545 B2 * 11/2014 Nakamura ..... G01M 15/08 73/114.18

(Continued)

FOREIGN PATENT DOCUMENTS

EP 2072897 A 6/2009
JP 02003074849 A * 3/2003 ..... F23Q 7/00

(Continued)

OTHER PUBLICATIONS

Office action dated Jan. 25, 2017 for the corresponding Japanese Patent Application No. 2013-089193.

*Primary Examiner* — Dana Ross
*Assistant Examiner* — Joe E Mills, Jr.
(74) *Attorney, Agent, or Firm* — Leason Ellis LLP

(57) ABSTRACT

A glow plug includes a housing having an axial hole extending in an axial line direction; a ceramic heater that is relatively displaceable with respect to the housing along the axial line direction and has at least outer surface made of ceramic; and a pressure sensor fixed to the housing and configured to output a signal based on the relative displacement of the ceramic heater. A fixed member fixed to the ceramic heater while the ceramic heater is arranged to an inner circumference of the fixed member. A welded member is welded to an outer circumference of the fixed member. An inner circumferential surface of a portion of the fixed member to which at least the welded member is welded is spaced apart from the outer surface of the ceramic heater.

15 Claims, 2 Drawing Sheets

(56) References Cited

U.S. PATENT DOCUMENTS 8,939,121 B2 * 1/2015 Nishiyuki ..... F23Q 7/001 123/145 A
9,091,443 B2 * 7/2015 Hatano ..... F23Q 7/001
9,249,975 B2 * 2/2016 Ratosa ..... G01L 23/222
9,347,854 B2 * 5/2016 Nishiyuki ..... G01M 15/08
2001/0009254 A1 * 7/2001 Taniguchi ..... F23Q 7/001 219/270
2004/0178185 A1 * 9/2004 Yoshikawa ..... F23Q 7/001 219/270
2005/0150301 A1 * 7/2005 Skinner ..... F02P 19/028 73/714
2006/0053875 A1 * 3/2006 Haussner ..... F23Q 7/001 73/114.19
2007/0241092 A1 * 10/2007 Suzuki ..... F23Q 7/001 219/260
2007/0295710 A1 * 12/2007 Yamada ..... F23Q 7/001 219/270
2008/0302323 A1 * 12/2008 Kern ..... G01L 23/22 123/145 A
2009/0194519 A1 * 8/2009 Funaki ..... F23Q 7/001 219/270
2009/0314061 A1 * 12/2009 Kern ..... F23Q 7/001 73/35.12
2010/0147822 A1 * 6/2010 Burrows ..... F23Q 7/001 219/267
2011/0005308 A1 * 1/2011 Kern ..... F23Q 7/001 73/114.16
2011/0114622 A1 * 5/2011 Sekiguchi ..... F23Q 7/001 219/270
2011/0240625 A1 * 10/2011 Takenouchi ..... F23Q 7/001 219/260
2011/0240628 A1 * 10/2011 Goretti ..... F23Q 7/001 219/270
2011/0271748 A1 * 11/2011 Maeda ..... G01L 23/08 73/114.18
2012/0160821 A1 * 6/2012 Ratosa ..... F23Q 7/001 219/270
2012/0187102 A1 * 7/2012 Cheng ..... F23Q 7/001 219/267
2013/0008886 A1 * 1/2013 Pottiez ..... F23Q 7/001 219/538
2013/0042831 A1 * 2/2013 Nishiyuki ..... G01L 23/10 123/145 A
2013/0047715 A1 * 2/2013 Ramond ..... F23Q 7/001 73/114.18
2013/0047716 A1 * 2/2013 Pottiez ..... G01L 23/22 73/114.19
2013/0206092 A1 * 8/2013 Pottiez ..... F23Q 7/001 123/145 A
2013/0248508 A1 * 9/2013 Ito ..... F23Q 7/001 219/270
2013/0269641 A1 * 10/2013 Watanabe ..... F23Q 7/001 123/145 A
2013/0269642 A1 * 10/2013 Ratosa ..... F23Q 7/001 123/145 A
2013/0298865 A1 * 11/2013 Ratosa ..... G01L 23/222 123/145 A
2013/0312691 A1 * 11/2013 Harada ..... F23Q 7/001 123/145 A
2013/0313244 A1 * 11/2013 Matsui ..... H05B 3/44 219/270
2013/0319094 A1 * 12/2013 Nakamura ..... G01M 15/08 73/114.19
2014/0109661 A1 * 4/2014 Pottiez ..... G01L 23/04 73/114.18
2014/0352640 A1 * 12/2014 Okinaka ..... F02P 19/028 123/145 A
2015/0300643 A1 * 10/2015 Takatsu ..... F23Q 7/001 219/209

FOREIGN PATENT DOCUMENTS

JP 2008-525758 A 7/2008
JP 2009-150570 A 7/2009
JP 2010-139147 A 6/2010
JP 2010-139150 A 6/2010
JP 2011-144978 A 7/2011
JP 2012170942 * 10/2011 ..... F23Q 7/00
JP 2013092353 A * 5/2013

* cited by examiner

GLOW PLUG WITH PRESSURE SENSOR

FIELD OF THE INVENTION

The present invention relates to a glow plug with a pressure sensor used in an internal combustion engine or the like.

BACKGROUND OF THE INVENTION

Conventionally, a glow plug used for ignition assist or the like of a diesel engine includes a cylindrical housing having an axial hole extending in the axial line direction, a heater inserted through the axial hole, and the like. Further, there is a case that a ceramic heater is employed as the heater. An existing ceramic heater has a configuration in which a conductive ceramic heating element is arranged inside an insulating ceramic base member and at least an outer surface of the heater is formed of ceramic.

Further, in recent years, a glow plug with a pressure sensor provided with a function for sensing the pressure of a combustion pressure or the like has been proposed as a glow plug. In such a glow plug with the pressure sensor, the ceramic heater is mounted in a state of being relatively displaceable with respect to a housing, and a front end part of the ceramic heater protrudes from the front end of the housing. When the ceramic heater receives the combustion pressure and the like and is relatively displaced, such relative displacement is transferred to the pressure sensor via a metallic transmission member connected to the ceramic heater, and a signal corresponding to the amount of the relative displacement of the ceramic heater (that is, the pressure applied to the ceramic heater) is outputted from the pressure sensor (for example, see JP-A-2011-144978).

In addition, in order to allow the ceramic heater to be relatively displaceable with respect to the housing, the ceramic heater is mounted to the housing via a cylindrical metallic movable member that is deformable in an extendible and contractive manner along the axial line direction. Here, when one whose outer surface is formed of ceramic is used as the ceramic heater, the outer surface of the ceramic heater cannot be directly welded to the movable member by laser welding or the like. Thus, in some cases, after the ceramic heater is arranged on the inner circumference of a cylindrical metallic outer cylinder and the ceramic heater is fixed to the outer cylinder by press-fit or the like, the movable member is welded to the outer circumference of the outer cylinder by laser welding or the like, so that the ceramic heater is indirectly connected to the movable member. In other words, the ceramic heater is connected to the movable member via the outer cylinder in some cases.

Further, similarly to the movable member, the transmission member cannot be directly welded to the outer surface of the ceramic heater. Thus, in some cases, after the ceramic heater is arranged on the inner circumference of a cylindrical metallic ring member and the ceramic heater is fixed to the ring member by press-fit or the like, the transmission member is welded to the outer circumference of the ring member by laser welding or the like, so that the ceramic heater is indirectly connected to the transmission member.

Problem to be Solved by the Invention

However, when the ceramic heater is fixed to the outer cylinder or the ring member (hereinafter referred to as fixed member) and then the movable member or the transmission member (hereinafter referred to as welded member) is welded to the outer circumference of the fixed member, there is a concern that the metallic fixed member relatively greatly expands due to the heat generated at the welding and a large tensile stress is applied to the ceramic heater from the fixed member. As a result, there is a concern that damage, such as a crack in the ceramic heater, may be caused.

The present invention has been made in view of the above circumstances, and, an object of the present invention is to provide a glow plug with a pressure sensor that includes a fixed member having an inner circumference to which a ceramic heater is fixed, and a welded member to be welded to the outer circumference of the fixed member in order to more reliably prevent damage on the ceramic heater when the welded member is welded to the fixed member.

SUMMARY OF THE INVENTION

Means for Solving the Problems

In the following, each configuration suitable to achieve the above object will be described for respective items. It is noted that particular effects and advantages will be added to the associated configuration if necessary.

Configuration 1: A glow plug with a pressure sensor of the present configuration includes:

a cylindrical housing having an axial hole extending in an axial line direction;

a ceramic heater that is inserted into the axial hole so that at least a front end part of the ceramic heater protrudes from a front end of the housing, that is relatively displaceable with respect to the housing along the axial line direction, and that has at least an outer surface made of ceramic; and a pressure sensor fixed directly or indirectly to the housing and configured to output a signal based on the relative displacement of the ceramic heater, and further includes a fixed member fixed to the ceramic heater while the ceramic heater is arranged to an inner circumference of the fixed member, and a welded member welded to an outer circumference of the fixed member, wherein an inner circumferential surface of a portion of the fixed member to which at least the welded member is welded is spaced apart from the outer surface of the ceramic heater.

According to the above-described configuration 1, the inner circumferential surface of the portion of the fixed member to which at least the welded member is welded is configured to be spaced apart from the outer surface of the ceramic heater. Therefore, at the welding, it is possible to effectively suppress that the stress is applied to the ceramic heater from the fixed member. As a result, it is possible to more reliably prevent damage on the ceramic heater.

Configuration 2: In the glow plug with the pressure sensor of the present configuration, in the above-described configuration 1, the fixed member is a cylindrical outer cylinder, and the welded member is a movable member that has one end side welded to the outer circumference of the outer cylinder and the other end side fixed to the housing, and is deformable along the axial line direction.

According to the above-described configuration 2, basically the same effects and advantages as the above-described configuration 1 are obtained. That is, it is possible to effectively suppress that the stress is applied to the ceramic heater from the outer cylinder in welding of the outer cylinder and the movable member, and to more reliably prevent the damage on the ceramic heater.

Further, when the movable member is welded to the outer cylinder while the outer cylinder is in contact with the ceramic heater, there is a concern that the thermal loss becomes large on the ceramic heater side of the outer cylinder and thus the outer cylinder is significantly deformed. As a result, there is a concern that an adhesion property between the outer cylinder and the ceramic heater is impaired and the airtightness is deteriorated. In this regard, according to the configuration 2, since the inner circumferential surface of the portion of the outer cylinder to which the movable member is welded is spaced apart from the outer surface of the ceramic heater, the deformation of the outer cylinder at the welding can be effectively suppressed. As a result, favorable airtightness can be maintained.

Configuration 3: In the glow plug with the pressure sensor of the present configuration, in the above-described configuration 1 or 2, the outer cylinder has a fixed outer diameter along the axial line direction.

As a technique for allowing the inner circumferential surface of the portion of the outer cylinder to which the movable member is welded to be spaced away from the outer surface of the ceramic heater, it can be considered to have the portion protrude toward the outer circumference side further than the remaining portion. In this case, while the outer diameter of one end side of the movable member is required to be relatively large, the larger outer diameter of the one end side of the movable member results in an increased spring coefficient in the movable member. Thus, there is a concern that the displacement amount of the ceramic heater when a pressure is applied thereto decreases and the pressure sensing accuracy is deteriorated.

In this regard, according to the above-described configuration 3, the outer cylinder is configured to have a fixed outer diameter along the axial line and thus there is no need to increase the outer diameter of the one end side of the movable member. Therefore, the increase in the spring coefficient in the movable member can be more reliably prevented, so that favorable pressure sensing accuracy can be provided.

Configuration 4: In the glow plug with the pressure sensor of the present configuration, in any one of the above-described configurations 1 to 3, the ceramic heater has a base member made of insulating ceramic and a heating element provided inside the base member, and the heating element has an electrode extraction part exposed in an outer surface of the base member, the fixed member is a cylindrical ring member whose inner circumference is in contact with the electrode extraction part, and the welded member is a transmission member that is welded to an outer circumference of the ring member and transfers a relative displacement of the ceramic heater to the pressure sensor.

According to the above-described configuration 4, the same effects and advantages as the above-described configuration 1 are obtained. That is, it is possible to effectively suppress that the stress is applied to the ceramic heater from the ring member in welding the transmission member to the ring member, and to more reliably prevent the damage on the ceramic heater.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
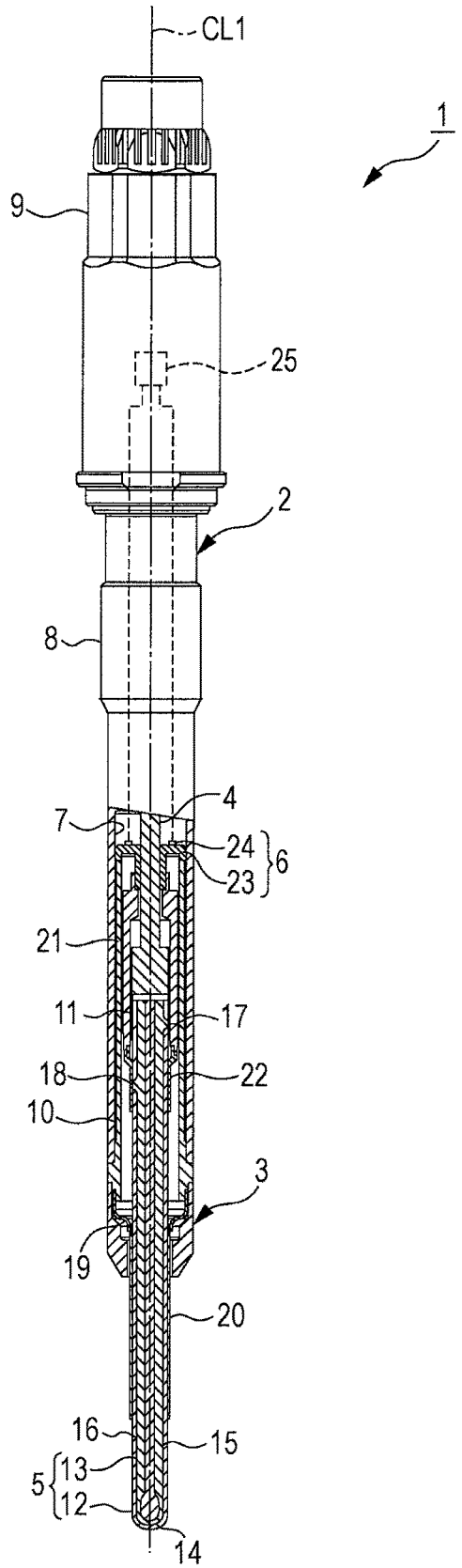
FIG. 1 is a partially sectional front view of a glow plug.

An embodiment will be described below with reference to the drawings. FIG. 1 is a partially sectional front view of a glow plug 1 with a pressure sensor (hereinafter simply referred to as "glow plug 1"). It is noted that, in FIG. 1, the lower side in the drawing is defined as the front end side of the glow plug 1 and the upper side is defined as the rear end side.

As illustrated in FIG. 1, the glow plug 1 includes a housing 2, a cap member 3, a center shaft 4, a ceramic heater 5, a pressure sensor 6, and the like.

The housing 2 is formed of a predetermined metallic material (for example, an iron material such as S45C) and has an axial hole 7 extending in a direction of an axial line CL1. Furthermore, an external thread 8 for mounting the glow plug 1 to a cylinder head and the like of an engine is formed on the outer circumference of the housing 2. In addition, a tool engagement part 9 having a hexagonal cross-section is formed on the outer circumference of the rear end part of the housing 2, and a tool used for the tool engagement part 9 is engaged thereto when the glow plug 1 (the external thread 8) is mounted to the cylinder head and the like.

Furthermore, a metallic sensor fixing member 10 shaped in a cylinder extending in the axial line CL1 direction is inserted in the inner circumference of the front end part of the housing 2. The front end part of the sensor fixing member 10 is joined to the front end part of the housing 2, and the rear end part thereof is joined to a later-described diaphragm 23 of the pressure sensor 6. Thereby, the pressure sensor 6 is in a state of being fixed to the housing 2 indirectly via the sensor fixing member 10.

The cap member 3 is shaped in a cylinder and joined to the front end part of the housing 2 via the front end part of the sensor fixing member 10. Further, the outer circumferential surface of the front end side of the cap member 3 is tapered toward the front end side in the axial line CL1 direction. When the glow plug 1 is mounted on the engine, the tapered portion is pressed against a seating portion of the engine to maintain the airtightness in the combustion chamber.

The center shaft 4 is inserted into the axial hole 7, made of metal, and shaped in a bar extending along the axial line CL1. Further, the front end part of the center shaft 4 is press-fitted in the rear end part of a cylindrical connection member 11 formed by a predetermined metal (for example, an iron material such as SUS), and the rear end part of the ceramic heater 5 is press-fitted in the front end part of the connection member 11. Thereby, the center shaft 4 and the ceramic heater 5 are mechanically and electrically connected to each other via the connection member 11. It is noted that the center shaft 4 and the ceramic heater 5 may be electrically connected to each other via a predetermined lead wire or the like in place of the connection member 11.

The ceramic heater 5 is inserted into the axial hole 7 in such a manner that a front end part of the ceramic heater 5 protrudes from the front end of the housing 2 (the cap member 3). Further, the ceramic heater 5 has a cylindrical base member 12 extending in the axial line CL1 direction and having a closed front end part, and a heating element 13 arranged inside the base member 12 and shaped in a thin U-shape. The base member 12 is made of insulating ceramic (for example, silicon nitride, alumina, or the like), while the heating element 13 is made of conductive ceramic containing silicon nitride as a main component and containing a conductive material (for example, molybdenum or tungsten silicide, nitride, carbide, or the like).

Further, the heating element 13 has a U-shaped heating part 14 arranged at the front end part of the ceramic heater 5 and a pair of bar-shaped lead parts 15 and 16 extending from respective ends of the heating part 14 toward the rear end side. The heating part 14 is a portion functioning as so-called heating resistor and has a U-shape at the front end portion of the ceramic heater 5 formed in a curved face such that the heating part 14 extends along the curved face.

Furthermore, the lead parts 15 and 16 extend substantially in parallel to each other toward the rear end side of the ceramic heater 5, respectively. Further, an electrode extraction part 17 protrudes toward the outer circumferential surface at the position close to the rear end of one lead part 15, and the electrode extraction part 17 is exposed in the outer circumferential surface of the base member 12. Similarly, an electrode extraction part 18 also protrudes toward the outer circumferential surface at the position close to the rear end of the other lead part 16, and the electrode extraction part 18 is exposed in the outer circumferential surface of the base member 12. It is noted that the electrode extraction part 17 of the one lead part 15 is located at the rear end side with respect to the electrode extraction part 18 of the other lead part 16 in the axial line CL1 direction.

Figure 2:
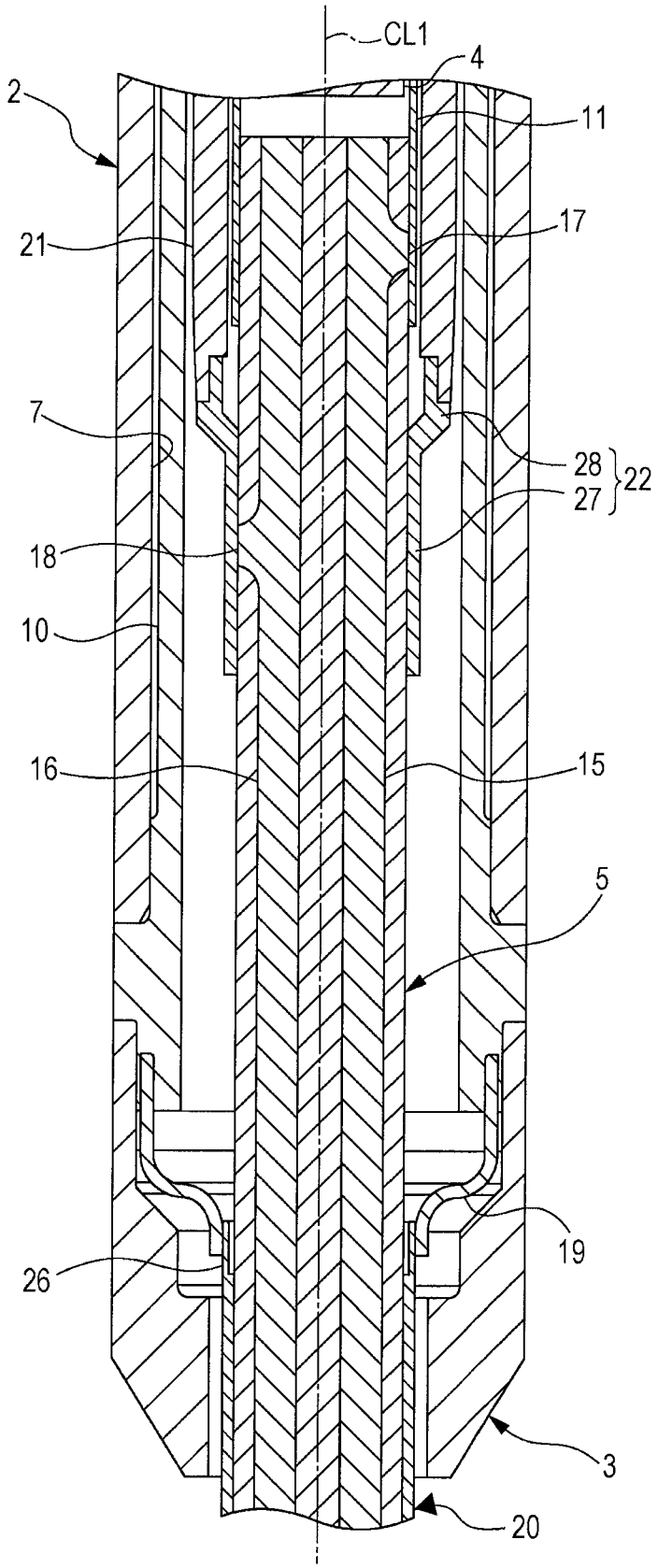
FIG. 2 is a partially enlarged sectional view of the glow plug.

In addition, as illustrated in FIG. 2, the exposed portion of the electrode extraction part 17 is in contact with the inner circumferential surface of the connection member 11 to have electrical conduction between the center shaft 4 connected to the connection member 11 and the lead part 15. Further, the exposed portion of the electrode extraction part 18 is in contact with the inner circumferential surface of a later-described ring member 22 electrically connected to the housing 2 to have electrical conduction between the housing 2 and the lead part 16. That is, in the present embodiment, the center shaft 4 and the housing 2 in the glow plug 1 function as an anode and a cathode for energizing the heating part 14 of the ceramic heater 5.

Further, in the present embodiment, the ceramic heater 5 is mounted to the housing 2 via a cylindrical movable member 19 (corresponding to "first welded member" of the present invention), one end of the movable member 19 is joined to the front end part of the housing 2. The movable member 19 is deformable in an extendible and contractive manner along the axial line CL1. Thus, the ceramic heater 5 is relatively displaceable along the axial line CL1 direction with respect to the housing 2 when a pressure such as a combustion pressure is applied to the front end part of the ceramic heater 5.

It is noted that, since the outer surface of the ceramic heater 5 is formed of ceramic, the ceramic heater 5 and the movable member 19 cannot be directly welded to each other. The present embodiment is then configured such that, while the ceramic heater 5 is press-fitted in the inner circumference of a cylindrical outer cylinder 20 (corresponding to "first fixed member" of the present invention) formed of a predetermined metal (for example, such as SUS630) and the ceramic heater 5 and the outer cylinder 20 are fixed to each other, one end side (the front end side) of the movable member 19 is welded to the outer cylinder 20 by laser welding or resistance welding. That is, the ceramic heater 5 is mounted to the movable member 19 via the outer cylinder 20. It is noted that the outer cylinder 20 is inserted through the cap member 3 in a state of being spaced apart from the inner circumferential surface of the cap member 3, and the thickness of the outer cylinder 20 is relatively small (for example, 0.6 mm or less).

Further, in the movable member 19, its one end side opening is formed to have a relatively small diameter while the other end side opening is formed to have a relatively large diameter. The movable member 19 has a plurality of (two in the present embodiment) bending portions between both of the openings. The movable member 19 is deformable in an extendible and contractive manner along the axial line CL1, together formed of a predetermined metal to be thin (for example, such as a stainless steel or a nickel alloy).

It is noted that, in the present embodiment, in the movable member 19, its one end side is welded to the outer cylinder 20 over the entire circumference and the other end is welded to the front end part of the housing 2 over the entire circumference. Thus, it is possible to more reliably prevent the combustion gas that has entered from the clearance provided between the cap member 3 and the outer cylinder 20 from entering the housing 2 and further leaking out to the outside.

In addition, the relative displacement of the ceramic heater 5 is transferred to the pressure sensor 6 via a cylindrical transmission member 21 (corresponding to "second welded member" of the present invention) whose rear end part is connected to the pressure sensor 6 (the diaphragm 23) (see FIG. 1). It is noted that, since the outer surface of the ceramic heater 5 is formed of ceramic, the transmission member 21 and the ceramic heater 5 cannot be directly welded to each other similarly to the case of the movable member 19. The present embodiment is then configured such that, while the ceramic heater 5 is press-fitted in a cylindrical ring member 22 (corresponding to "second fixed member" of the present invention) made of a predetermined metal (for example, such as SUS630) and the ceramic heater 5 and the ring member 22 are fixed to each other, the front end part of the transmission member 21 is welded to the outer circumference of the rear end part of the ring member 22 by laser welding or resistance welding. That is, the ceramic heater 5 is connected to the transmission member 21 via the ring member 22. It is noted that the ring member 22 is inserted through the sensor fixing member 10 in a state of being spaced apart from the inner circumference of the sensor fixing member 10, and the thickness of the ring member 22 is relatively small (for example, 0.9 mm or less).

Turning back to FIG. 1, the pressure sensor 6 is provided on the front end side with respect to the middle part in the axial line CL1 direction of the housing 2, and includes the metallic (for example, stainless steel) diaphragm 23 having a through-hole at its center through which the center shaft 4 penetrates, and a sensor element 24 (a piezo resistor in the present embodiment) joined to the rear end-side face of the diaphragm 23. The rear end part of the transmission member 21 is joined to the diaphragm 23 and, when the ceramic heater 5 is displaced due to application of a pressure such as a combustion pressure, the diaphragm 23 is bent and deformed according to the displacement amount of the ceramic heater 5.

Further, the sensor element 24 changes its resistance value in response to the bending and deformation of the diaphragm 23. The resistance value of the sensor element 24 is converted into and amplified to a voltage value by an integration circuit 25 provided inside the housing 2, and a signal of the converted and amplified voltage value (that is, a signal indicating the pressure received by the ceramic heater 5) is outputted to an external circuit (not shown) such as ECU via a not-shown cable or the like.

Next, the characteristic features of the present invention will be described. As described above, while the outer cylinder 20 is welded to the movable member 19, the inner circumferential surface of the portion of the outer cylinder 20 to which the movable member 19 is welded is configured to be spaced apart from the outer surface of the ceramic heater 5 as illustrated in FIG. 2 in the present embodiment. Specifically, the outer cylinder 20 has a fixed outer diameter along the axial line CL1. In addition, the outer cylinder 20 has a thin part 26 whose inner diameter is larger than the inner diameter of the remaining portion at the rear end part to which the movable member 19 is welded. The inner circumferential surface of the thin part 26 is spaced apart from the outer surface of the ceramic heater 5. It is noted that, in the present embodiment, the distance between the inner circumferential surface of the portion of the outer cylinder 20 (the thin part 26) to which the movable member 19 is welded and the outer surface of the ceramic heater 5 is set to be within a predetermined numeric range (for example, 0.1 mm or greater and 0.4 mm or smaller).

Furthermore, as described above, while the ring member 22 is welded to the transmission member 21, the present embodiment is configured such that the inner circumferential surface of the portion of the ring member 22 to which the transmission member 21 is welded is spaced apart from the outer surface of the ceramic heater 5. Specifically, the ring member 22 includes a smaller diameter part 27 holding the ceramic heater 5 and a larger diameter part 28 whose inner diameter is larger than the inner diameter of the smaller diameter part 27. The transmission member 21 is welded to the outer circumference of the large diameter part 28. The inner circumferential surface of the larger diameter part 28 is spaced apart from the outer surface of the ceramic heater 5. It is noted that, in the present embodiment, the distance between the inner circumferential surface of the portion of the ring member 22 (the larger diameter part 28) to which the transmission member 21 is welded and the outer surface of the ceramic heater 5 is set to be within a predetermined numeric range (for example, 0.1 mm or greater and 1.2 mm or smaller).

As described above in detail, it is possible to effectively suppress that the stress is applied to the ceramic heater 5 from the outer cylinder 20 in welding of the outer cylinder 20 and the movable member 19 according to the embodiment. Further, it is possible to effectively suppress that the stress is applied to the ceramic heater 5 from the ring member 22 in welding of the transmission member 21 and the ring member 22. As a result of the above, the damage on the ceramic heater 5 can be more reliably prevented.

Further, if the movable member 19 is welded to the outer cylinder 20 in a state that the inner circumferential surface of the portion of the outer cylinder 20 to which the movable member 19 is welded is in contact with the outer surface of the ceramic heater 5, there is a concern that the thermal loss becomes large on the ceramic heater 5 side of the outer cylinder 20. Thus the outer cylinder 20 is deformed relatively largely, resulting in that the adhesion property between the outer cylinder 20 and the ceramic heater 5 is impaired and the airtightness is deteriorated. In this regard, in the present embodiment, since the inner circumferential surface of the portion of the outer cylinder 20 to which the movable member 19 is welded is spaced apart from the outer surface of the ceramic heater 5, the deformation of the outer cylinder 20 at the welding can be effectively suppressed. Together with the above configuration, as the movable member 19 is welded to the outer cylinder 20 and the housing 2 over the entire circumference of the movable member 19, favorable airtightness can be maintained in the combustion chamber.

In addition, the outer cylinder 20 is configured to have a fixed outer diameter along the axial line CL1, and it is not necessary to increase the outer diameter of one end side of the movable member 19. Therefore, the increase of the spring coefficient in the movable member 19 can be more reliably prevented, so that favorable pressure sensing accuracy can be provided.

It is noted that, without limited to the description of the above-described embodiment, the following implementations may be employed, for example. Other application examples and modified examples that are not exemplified in the following are of course possible.

(a) While both of the inner circumferential surface of the portion of the outer cylinder 20 to which the movable member 19 is welded and the inner circumferential surface of the portion of the ring member 22 to which the transmission member 21 is welded are spaced apart from the outer surface of the ceramic heater 5 in above-described the embodiment, one of the both may be spaced apart from the outer surface of the ceramic heater 5.

(b) While the ceramic heater 5 is fixed to the outer cylinder 20 or the ring member 22 by being press-fitted into the outer cylinder 20 or the ring member 22 in the above-described embodiment, the technique for fixing the ceramic heater 5 to the outer cylinder 20 or the like is not limited in particular. Therefore, the ceramic heater 5 may be fixed to the outer cylinder 20 or the like by blazing or the like, for example.

(c) The arrangement location of the pressure sensor 6 in the above-described embodiment is merely an example, and the arrangement location of the pressure sensor 6 is not limited in particular. Therefore, the pressure sensor may be provided to the inner circumference on the rear end side of the housing 2, or the pressure sensor may be provided outside the housing 2.

(d) While the piezo-resistor is provided as the sensor element in the above-described embodiment, the piezoelectric device or the like may be used as the sensor element.

(e) While the ceramic heater 5 has a round bar shape, that is, has a circle cross-section in the above-described embodiment, it is not always necessary to have the circle cross-section. It may have an elliptic cross-section, an oval cross-section, or a polygonal cross-section, for example. Further, the technical concept of the present invention may be applied to so-called plate-like heater in which a plurality of plate-like base members is formed and a heating element is interposed therebetween.

(f) As long as the movable member 19 is deformable along the axial line CL1 direction, its shape is not limited in particular. Therefore, as the movable member, a member having a bellows-like cylindrical part extending along the axial line CL1 direction may be used, for example. Further, an annular member extending in the direction intersecting the axial line CL1 and being able to bend and deform in the axial line CL1 direction may be used.

DESCRIPTION OF REFERENCE NUMERALS

1: Glow plug (glow plug with pressure sensor)
2: Housing
5: Ceramic heater
6: Pressure sensor

7: Axial hole
12: Base member
13: Heating element
18: Electrode extraction part
19: Movable member (first welded member)
20: Outer cylinder (first fixed member)
21: Transmission member (second welded member)
22: Ring member (second fixed member)
CL1: Axial line

The invention claimed is:

1. A glow plug with a pressure sensor comprising:
a cylindrical housing having an axial hole extending in an axial line direction;
a ceramic heater that is inserted into the axial hole so that at least a front end part of the ceramic heater protrudes from a front end of the housing, said ceramic heater being relatively displaceable with respect to the housing along the axial line direction, and having at least an outer surface made of ceramic;
a pressure sensor fixed directly or indirectly to the housing and configured to output a signal based on a relative displacement of the ceramic heater;
a fixed member fixed to the ceramic heater at a first joint portion while the ceramic heater is arranged to an inner circumference of the fixed member; and
a welded member welded to an outer circumference of the fixed member at a second joint portion, wherein
an inner circumferential surface of the second joint portion is spaced apart from the outer surface of the ceramic heater, and
the second joint portion is positioned rearward in the axial line direction with respect to the first joint portion.

2. The glow plug with the pressure sensor according to claim 1, further comprising:
a first fixed member fixed to the ceramic heater; and
a first welded member welded to an outer circumference of the first fixed member, wherein
the first fixed member is a cylindrical outer cylinder, and
the first welded member is a movable member that has one end side welded to the outer circumference of the outer cylinder and the other end side fixed to the housing, and is deformable along the axial line direction.

3. The glow plug with the pressure sensor according to claim 2, wherein the outer cylinder has a fixed outer diameter along the axial line direction.

4. The glow plug with the pressure sensor according to claim 1, wherein
the ceramic heater has a base member made of insulating ceramic and a heating element provided inside the base member,
the heating element has an electrode extraction part exposed in an outer surface of the base member,
the fixed member is a cylindrical ring member whose inner circumference is in contact with the electrode extraction part, and
the welded member is a transmission member that is welded to an outer circumference of the ring member and transfers a relative displacement of the ceramic heater to the pressure sensor.

5. The glow plug with the pressure sensor according to claim 2, wherein an inner most surface of the first welded member abuts an outer most surface of the first fixed member.

6. The glow plug with the pressure sensor according to claim 1, wherein a front end portion of the fixed member is located more frontward than a front end portion of the welded member.

7. The glow plug with the pressure sensor according to claim 1, wherein a rear end portion of the fixed member is located more frontward than a rear end portion of the welded member.

8. The glow plug with the pressure sensor according to claim 2, wherein any part of an outer diameter of the first fixed member is smaller than any part of an inner diameter of the first welded member.

9. The glow plug with the pressure sensor according to claim 4, wherein an inner surface of the ring member abuts an outer surface of the electrode extraction part.

10. The glow plug with the pressure sensor according to claim 1, wherein a front-most end of the welded member abuts a rear-facing end of the fixed member.

11. The glow plug with the pressure sensor according to claim 1, wherein a rear-most end of the fixed member abuts a front-facing end of the welded member.

12. A glow plug with a pressure sensor comprising:
a cylindrical housing having an axial hole extending in an axial line direction;
a ceramic heater that is inserted into the axial hole so that at least a front end part of the ceramic heater protrudes from a front end of the housing, said ceramic heater being relatively displaceable with respect to the housing along the axial line direction, and having at least an outer surface made of ceramic;
a pressure sensor fixed directly or indirectly to the housing and configured to output a signal based on a relative displacement of the ceramic heater;
a fixed member fixed to the ceramic heater while the ceramic heater is arranged to an inner circumference of the fixed member; and
a welded member welded to an outer circumference of the fixed member, wherein
an inner circumferential surface of a portion of the fixed member, to which at least the welded member is welded, is spaced apart from the outer surface of the ceramic heater,
the ceramic heater has a base member made of insulating ceramic and a heating element provided inside the base member, an outer surface of the base member contacting an inner surface of the fixed member, and
the heating element has an electrode extraction part exposed in an outer surface of the base member.

13. The glow plug with the pressure sensor according to claim 1, wherein
the fixed member comprises a smaller diameter part and a larger diameter part, and
a portion of the larger diameter part is welded to the welded member to form the welding portion.

14. The glow plug with the pressure sensor according to claim 1, wherein the fixed member has a thin part whose inner diameter is larger than an inner diameter of a remaining portion of the fixed member.

15. The glow plug with the pressure sensor according to claim 14, wherein a distance between an inner surface of the thin part and the outer surface of the ceramic heater is in a range of 0.1 mm to 1.2 mm.

* * * * *